US005583435A

United States Patent [19]

Takemoto et al.

[11] Patent Number: 5,583,435

[45] **Date of Patent: *Dec. 10, 1996**

[54] SENSOR WITH A PLURALITY OF TRANSMISSION AND RECEPTION LINES FOR DETECTING A POSITION OF A METAL OBJECT

[75] Inventors: Takatoshi Takemoto; Kazunari Kawashima, both of Tokyo; Shigeru Handa, Hachioji, all of Japan

[73] Assignee: Kabushiki Kaisha Ace Denken, Tokyo, Japan

[ * ] Notice: The term of this patent shall not extend beyond the expiration date of Pat. No. 5,405,143.

[21] Appl. No.: 244,102

[22] PCT Filed: Nov. 20, 1991

[86] PCT No.: PCT/JP91/01595

§ 371 Date: May 19, 1994

§ 102(e) Date: May 19, 1994

[87] PCT Pub. No.: WO93/09858

PCT Pub. Date: May 27, 1993

[51] Int. Cl.[6] ..... H01F 5/00; A63F 7/02

[52] U.S. Cl. ..... 324/207.17; 324/243; 324/260; 273/239; 273/121 A

[58] Field of Search ..... 324/207.15, 207.16, 324/207.17, 232, 243, 260, 262; 273/120 A, 121 A, 121 B, 237–239; 340/540, 541, 551, 552

[56] References Cited

U.S. PATENT DOCUMENTS

| | | | |
|---|---|---|---|
| 4,605,898 | 8/1986 | Aittoniemi et al. | 340/551 |
| 4,733,023 | 3/1988 | Tamaru et al. | 324/207.17 |
| 5,013,047 | 5/1991 | Schwab | 273/238 |
| 5,082,286 | 1/1992 | Ryan et al. | 273/238 |
| 5,405,143 | 4/1995 | Takemoto et al. | 273/120 A |

FOREIGN PATENT DOCUMENTS

| | | |
|---|---|---|
| 51-19379 | 6/1976 | Japan . |
| 52-15354 | 2/1977 | Japan . |
| 60-20276 | 2/1985 | Japan . |
| 60-114283 | 6/1985 | Japan . |
| 60-188393 | 12/1985 | Japan . |
| 61-181480 | 8/1986 | Japan . |
| 61-179181 | 8/1986 | Japan . |
| 64-3506 | 1/1989 | Japan . |

*Primary Examiner*—Sandra L. O'Shea
*Assistant Examiner*—Jay M. Patidar
*Attorney, Agent, or Firm*—Lowe, Price, LeBlanc & Becker

[57] ABSTRACT

A sensor of the invention has a plurality of transmission lines (22) being energized for generating a magnetic field, a board for supporting the transmission lines (22), a plurality of reception lines (26) being electro-magnetically coupled with the transmission lines (22) for detecting a magnetic flux change made by the approach of the metal object, and a board for supporting the reception lines (26). The transmission lines (22) and the reception lines (26) are made of conductive thin films formed on their respective boards having sending and returning paths. The transmission lines (22) and the reception lines (26) are laid out in a direction to cross each other with the boards between.

10 Claims, 12 Drawing Sheets

SENSOR WITH A PLURALITY OF TRANSMISSION AND RECEPTION LINES FOR DETECTING A POSITION OF A METAL OBJECT

BACKGROUND OF THE INVENTION

This invention relates to a sensor for detecting the position of a metal object and in particular to a sensor appropriate for detecting the position of a metal object in a space sandwiched between parallel planes, for example.

TECHNICAL BACKGROUND

Devices requiring a sensor for detecting the position of a metal object include metal detectors, game machines, etc. For example, with some game machines, a player moves a metal object, such as a metal ball, in a specific space set within the game machine and may or may not win the play depending on the destination of the metal ball. Pinball machines are typical of such game machines; with a pinball machine, a player plays a game by dropping a pinball (a metal ball) in a space sandwiched between parallel planes in which a large number of obstacles are located.

The pinball machine has a board face for providing a space required to move pinballs, a glass plate spaced from the board face at a given interval to cover the board face, and a propelling mechanism for propelling pinballs to the top of the board face. The pinball machine is set up so that the board face becomes substantially parallel to the vertical direction. The board face is formed with a plurality of safe holes, into which the player attempts to cause a pinball to enter for a winning play (hit), in response to which the pinball is discharged from the board face, and an out hole into which pinballs not entered in the safe holes are finally collected for discharging the pinballs from the board face.

A large number of pins (nails) are set up substantially vertical to the board face in a state in which they project from the board face as far as the diameter of a pinball as obstacles with which pinballs dropping along the board face frequently collide for causing the motion direction thereof to fluctuate. The pins are located on the board face with a distribution determined so as to guide pinballs colliding with the pins toward or away from the safe holes while causing the motion directions of the pinballs to fluctuate.

Since the pinball machines have such a structure, some pinball machines may easily register hits and some may be caused to hit only with difficulty, depending on a slight difference in pin layout or inclination. Also, at a single machine, some safe holes may be high in hit average and some may be low; the hit average difference among the safe holes varies from one machine to another.

At game houses, etc., having a large number of such game machines, it is important on management such as profit management and customer management for personnel of the game house to know the characters of the respective game machines. For example, if many machines are easy to hit, the game house suffers a loss; if most machines are hard to hit, the customers lose interest in play and the game house will lose business. Therefore, personnel need to know the characters of the respective game machines installed in the house and take action accordingly.

To this end, a passage of a pinball is detected in pinball machines. As a sensor used for this purpose, a sensor provided with an upper sheet and a lower sheet forming contact pairs is disclosed in Japanese Patent Publication No. Sho 64-3506, for example. In the art described here, a pinball is placed on the upper sheet and presses it, whereby contact pairs contact in sequence as the pinball passes for detecting the of the pinball.

However, since the conventional sensor has the contact pairs, a layout of the sheets is limited; the sheets can be laid out only along passages of pinballs. Thus, the sensor cannot detect pinball motion from the viewpoint of seeing the entire board face. Thus, it is difficult for the sensor to determine how pinballs enter the save holes and the out hole.

Since a pinball is detected by physical contact of the contact pairs, pressure against the sheet may become weak depending on the pinball motion state, in which case some contact pairs cannot contact and the pinball may be unable to be detected. Also, a contact failure may occur due to abrasion, corrosion, or the like of the contact pairs. Further, the contact pairs may erroneously contact due to vibration, chattering, or the like. Thus, the sensor has a problem of lacking reliability.

Further, the sensor, which uses pressure of pinballs, also introduces a problem of delicately affecting pinball motion.

Such problems may occur on other devices as well as the pinball machines. Therefore, it is desired to work out some countermeasure.

SUMMARY OF THE INVENTION

It is therefore an object of the invention to provide a sensor for detecting the position of a metal object which can detect any desired position of a metal object in a specific space without contact with the metal object and without using contacts involving physical contact, and to produce the detection result providing high reliability.

To this end, according to the invention, there is provided a sensor for detecting a position of a metal object comprising a plurality of transmission lines being energized for generating a magnetic field, a board for supporting the transmission lines, a plurality of reception lines being electromagnetically coupled with the transmission lines for detecting a magnetic flux change made by approach of the metal object, and a board for supporting the reception lines, wherein the transmission lines and the reception lines are made of conductive thin films formed on their respective boards having sending and returning paths, and are laid out in a direction to cross each other with the boards between.

The transmission lines and the reception lines can cross each other so that their cross portions are laid out like a matrix.

The areas surrounded by the sending and returning paths of the transmission lines and the reception lines in the cross portions can be made, for example, substantially quadrilaterals.

Each of the transmission lines and the reception lines can comprise two layers of a metal pattern formed on their respective boards and a metal film formed on the metal pattern as the conductive thin film. The transmission and reception lines can each comprise a transparent conductive film formed on the board and a metal film formed on the transparent conductive film as the conductive thin film. In these cases, glass boards may be used as the boards.

The direct current resistance value of each of the transmission lines and the reception lines can be set in the range of 20 to 200Ω, for example.

When an electric current flows into a turned transmission line for generating a magnetic field, an induced current is induced on the reception line near the transmission line by electromagnetic induction. At this time, if a metal object approaches the transmission line and the reception line, an eddy current is generated on the surface of the metal object in a direction to negate a magnetic flux by the transmission line. Thus, the scale of the induced current induced on the reception line is changed by the effect of the eddy current. The approach of the metal object can be detected by detecting the change.

DESCRIPTION OF THE PREFERRED EMBODIMENTS

Referring now to the accompanying drawings, there are shown preferred embodiments of the invention.

FIGS. 1 to 8 shows a first embodiment of the invention. In the first embodiment, a metal sensor is used as a metal detector for application to a game machine 10.

Figure 2:
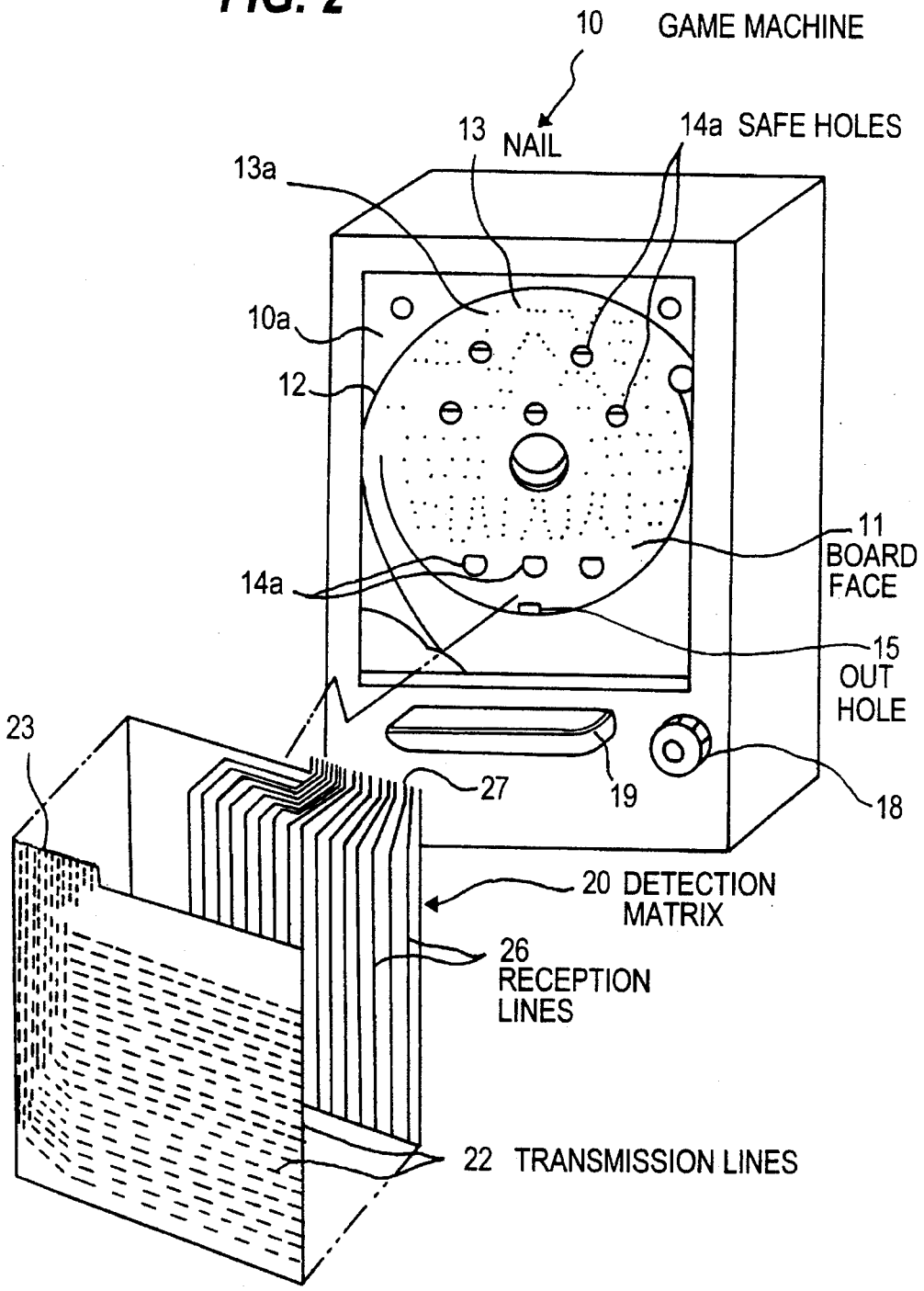
FIG. 2 is perspective views of a game machine and the detection matrix as a conceptual exploded view.
Figure 3:
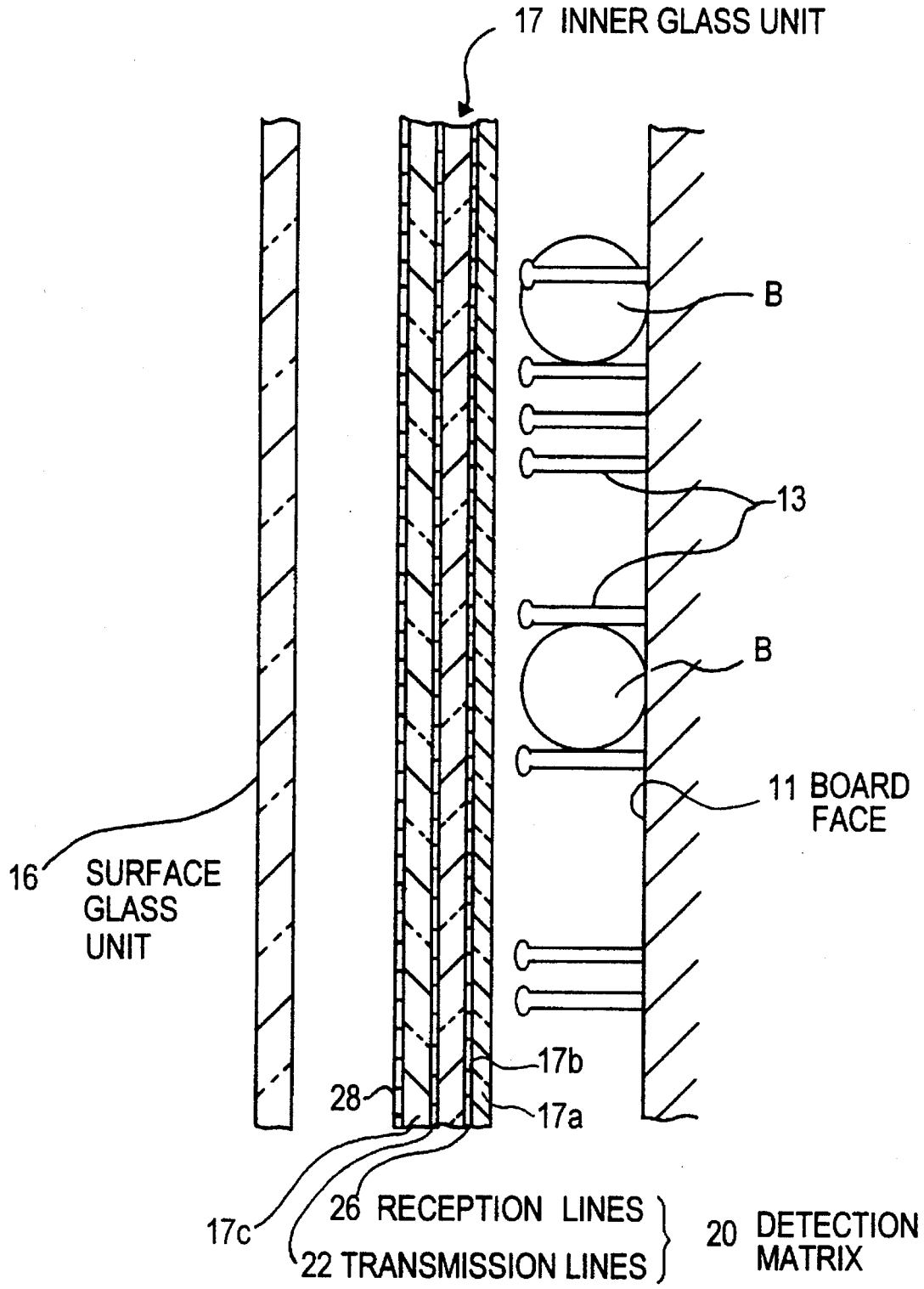
FIG. 3 is a partial vertical sectional view of the games machine.

The game machine 10 has a board face 11 for providing a space required to move metal objects B, a glass cover 10*a* spaced from the board face at a given interval to cover the board, and a propelling mechanism for propelling metal objects to the top of the board face 11, as shown in FIGS. 2 and 3. The game machine 10 is set up so that the board face 11 becomes substantially parallel to the vertical direction. The board face 11 of the game machine 10 is formed with a guide rail 12 for defining a game area. This means that the game area is provided inside the guide rail 12. A large number of pins (nails) 13, for bouncing metal objects B are hammered into the board face 11 in the game area. A plurality of safe holes 14*a*, are made at various points and one out hole 15 is made at the bottom of the game area.

The pins 13 are set up substantially vertical to the board face 11 in a state in which they project from the board face 11 as far as the diameter of the metal object B, as shown in FIG. 3.

The pins 13 are laid out as obstacles along the course with which a metal object dropping between the pins 13 along the board face 11 frequently collides for causing the motion direction of the metal object to fluctuate. More specifically, the pins 13 are grouped into pin strings or pin groups 13*a*, as shown in FIG. 2. The pin strings or pin groups 13*a* are located as a distribution determined so as to guide the metal objects colliding with the pins 13 toward or away from the safe holes 14*a* while causing the motion directions of the metal objects to fluctuate in response to the metal object propelling position or drop start position and the motion direction, speed, etc., of the metal object at the time.

The safe hole 14*a* is a hole into which a player trys to cause a metal object to enter for a winning play (hit) through which the metal object is discharged from the board face 11. On the other hand, the out hole 15 is a hole into which metal objects not entering into the safe holes 14*a* are finally collected for discharging the pinballs from the board face 11.

The front glass cover 10*a* for covering the board face 11 consists of a surface glass unit 16 and an inner glass unit 17.

The propelling mechanism has a propelling handle 18 and a drive mechanism (not shown). The handle 18 is located on the front face of the game machine 10 for a player to propel metal objects by turning the handle 18 at any desired angle.

A ball saucer 19 for receiving metal objects paid out from the game machine 10 is also located on the front face of the game machine 10. When a metal object projected to the top of the board face 11 falls into any safe hole 14*a*, a predetermined number of metal objects are paid out for a winning play.

A detection matrix 20 forming a metal sensor is disposed along the board face 11 of the game machine 10, as shown in FIGS. 2 and 3. The detection matrix 20 is built on the inside when viewed from the game machine 10, namely, into the inner glass unit 17, which is the side nearest the ball face 11, of the surface glass unit 16 and the inner glass unit 17 making up the front glass cover 10*a* covering the board face 11.

The inner glass unit 17 comprises three laminated layers of an internal protection glass plate 17*a* which is a protection sheet for reception lines 26, a glass base board 17*b*, and an outer glass plate 17*c* which is a protection sheet for transmission lines 22. The reception lines 26 (described below) are sandwiched between the internal protection glass plate 17*a* and the glass base board 17*b*. The transmission lines 22 (described below) are sandwiched between the glass base board 17*b* and the outer glass plate 17*c*.

A transparent conductive film 28 for shielding is provided on the full surface of the outer glass plate 17*c* on the surface of the transmission lines 22. The transparent conductive film 28 is made of an indium tin oxide (I.T.O.) film, tin oxide film, etc.

Figure 1:
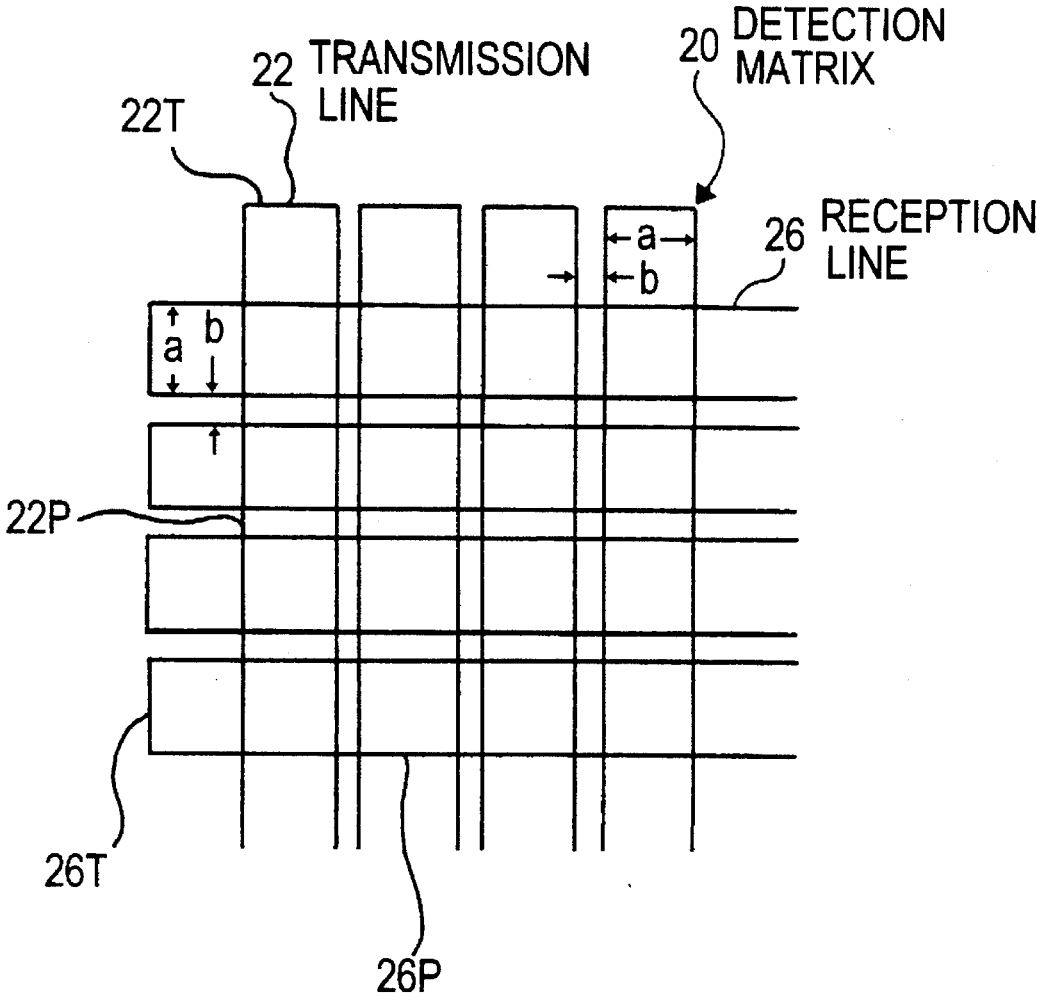
FIG. 1 is a schematic front view showing the form of a detection matrix used in a first embodiment of the invention.

As shown in FIG. 1, each transmission line 22 has a parallel section 22P comprising a sending path and a returning path in parallel and a turn section 22T at which the sending path turns to the returning path for making a turn part (or a loop).

Each reception line 26 has a parallel section 26P comprising a sending path and a returning path in parallel and a turn section 26T at which the sending path turns to the returning path for making a turn part (or a loop). A plurality of the transmission lines 22 are laid out on the glass base board **17*b* so that their parallel sections 22P are arranged within the same plane and become parallel to each other. Likewise, a plurality of the reception lines 26 are laid out on the glass base board 17*b* so that their parallel sections 26P are arranged within the same plane and become parallel to each other. The transmission lines 22 are arranged in a row direction and the reception lines 26** are arranged in a column direction, for example, so that they cross each other to make up the detection matrix.

Figure 5:
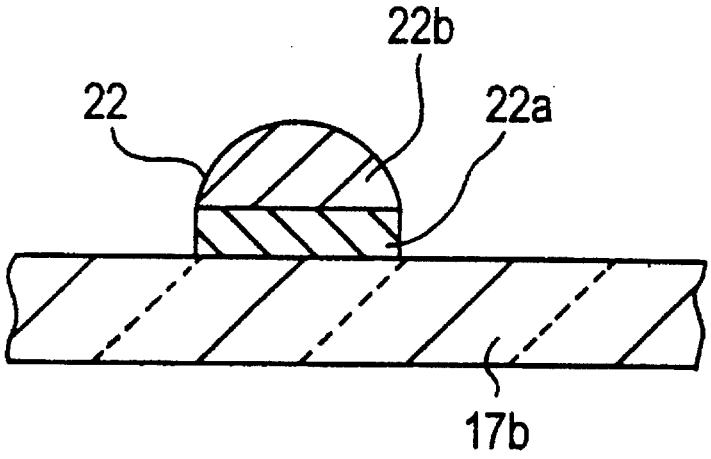
FIG. 5 is an enlarged sectional view of one example of a transmission or reception line used in the invention.

To form the transmission line 22, as shown in FIG. 5, first a film of metal such as aluminum is formed on the surface of one side of the glass base board **17*b* by means of deposition or the like for forming a transmission line pattern 22*a* like a turn. Next, on the deposition part, a film of metal such as copper is formed along the pattern by means of plating, deposition, or the like for forming a metal pattern 22*b*. Likewise, to form the reception line 26, aluminum is deposited on the surface of the other side of the glass base board 17*b*** for forming a reception line pattern like a turn on which a film of copper is formed for forming a metal pattern.

Reactivity of the transmission line 22 and/or the reception line 26 can be controlled by changing the film thickness of the copper film.

For example, if the copper film is thickened, direct current resistance of the transmission line 22 and/or reception line 26 is lowered, increasing the reactivity to metal objects.

The inner glass unit 17 comprises the internal protection glass plate **17*a* bonded to the reception lines 26 of the glass base board 17*b* and the outer glass plate 17*c* bonded to the transmission lines 22** by a transparent adhesive.

As shown in FIG. 1, a plurality of the transmission lines 22, each of which makes a U turn for parallel sending and returning paths, are disposed on the same plane in parallel in one direction. Likewise, a plurality of the reception lines 26, each of which makes a U turn for parallel sending and returning paths, are disposed on the same plane in parallel in one direction.

The respective reception lines 26 are located near the respective transmission lines 22 so that they can be electromagnetically coupled. That is, the reception lines 26 are disposed in a direction to cross at right angles to the plane parallel to each transmission line 22 (that is, with the plane containing the transmission line 22 like a turn and the plane containing the reception line 26 like a turn parallel to each other) so that the electro-magnet characteristic changes as metal such as a metal object B approaches.

In the front view of the detection matrix in FIG. 1, quadrilateral portions surrounded by the sending and returning paths of the transmission lines 22 and the reception lines 26 crossing each other provide detection units for sensing a metal object, **20*a*. The detection unit 20*a*** is formed substantially like a square in the embodiment, but is not limited to the quadrilateral or square as shown in embodiments described below.

Figure 4:
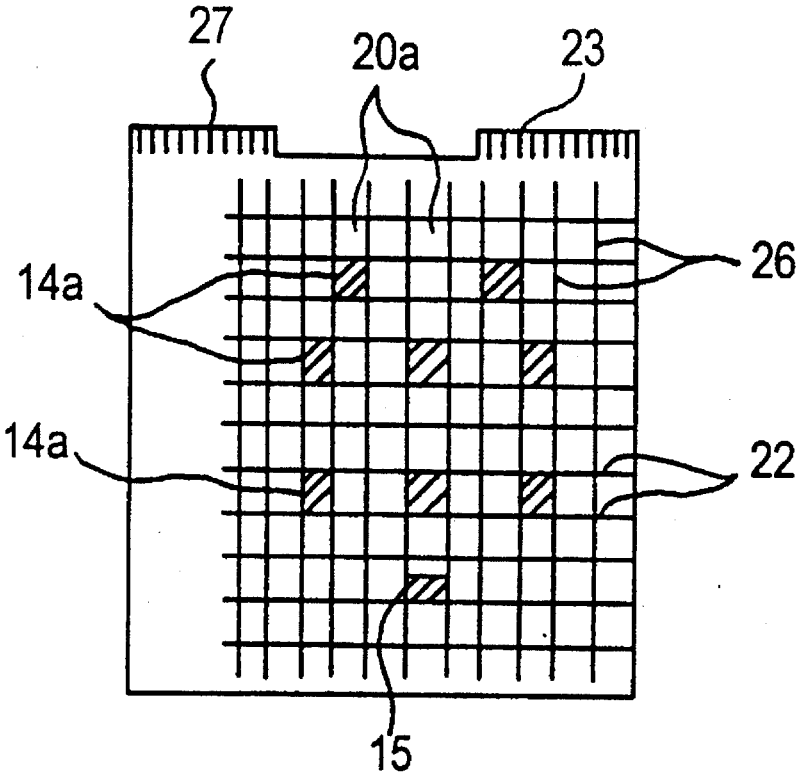
FIG. 4 is a front view of the detection matrix.

External connection terminals 23 and 27 are provided at the ends of the transmission lines 22 and the reception lines 26. As shown in FIG. 4, some of the detection units **20*a* correspond to the positions of the safe holes 14*a***.

The pattern forms of the transmission lines 22 and the reception lines 26 are very fine in relation with the size of a metal object B; if the detection units **20*a* are too large, resolution worsens and if they are too small, a plurality of detection units respond to one metal object, thus their positional relationship becomes hard to grasp, Then, the DC resistance values of the transmission lines 22 and the reception lines 26** are set to preferably 10 to 200Ω or about 25Ω as the optimum value at which reactivity to metal objects B is the best.

As shown in FIG. 1, the turn width (spacing between the sending and returning paths) of each transmission line 22, reception line 26, a, is set to preferably 4 to 16 mm or 8 mm as the optimum value as the width at which reactivity for detecting metal objects B is good. The width between the transmission lines 22 and between the reception lines 26, b, is 0.5 to 2 mm or so, indicating a good result.

A pattern of the detection matrix 20 appropriate for the game machine 10 consists of, for example, 32 rows of the transmission lines 22 and 32 columns of the reception lines 26 forming 1024 detection units **20*a*** in total.

The thickness of a conductor forming each of the transmission lines 22 and the reception lines 26 also has a large effect on the sensitivity. That is, if the conductor is thin, impedance is too high; if it is thick, the inner diameter of the pattern becomes small, worsening the sensitivity.

Further, the detection matrix 20, which is contained in the inner glass unit 17 covering the board face 11, needs to be made as thin as possible so as not to spoil the view when playing. Then, the thickness of each of the conductors forming the transmission lines 22 and the reception lines 26 is preferably set to 20 to 50 μm.

Figure 6:
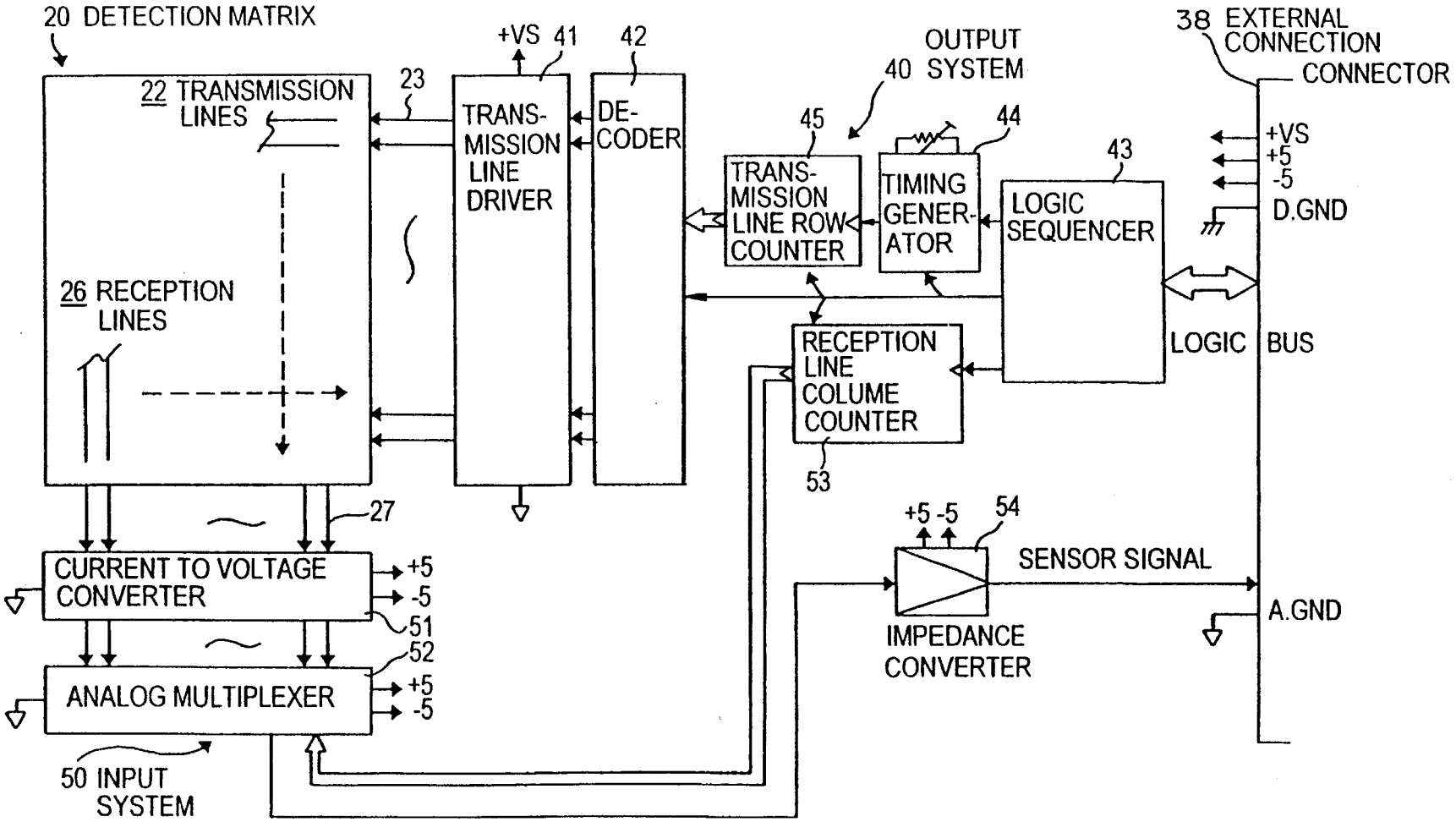
FIG. 6 is a block diagram showing the portion on the game machine side in one example of a signal processing system used in the invention.
Figure 7:
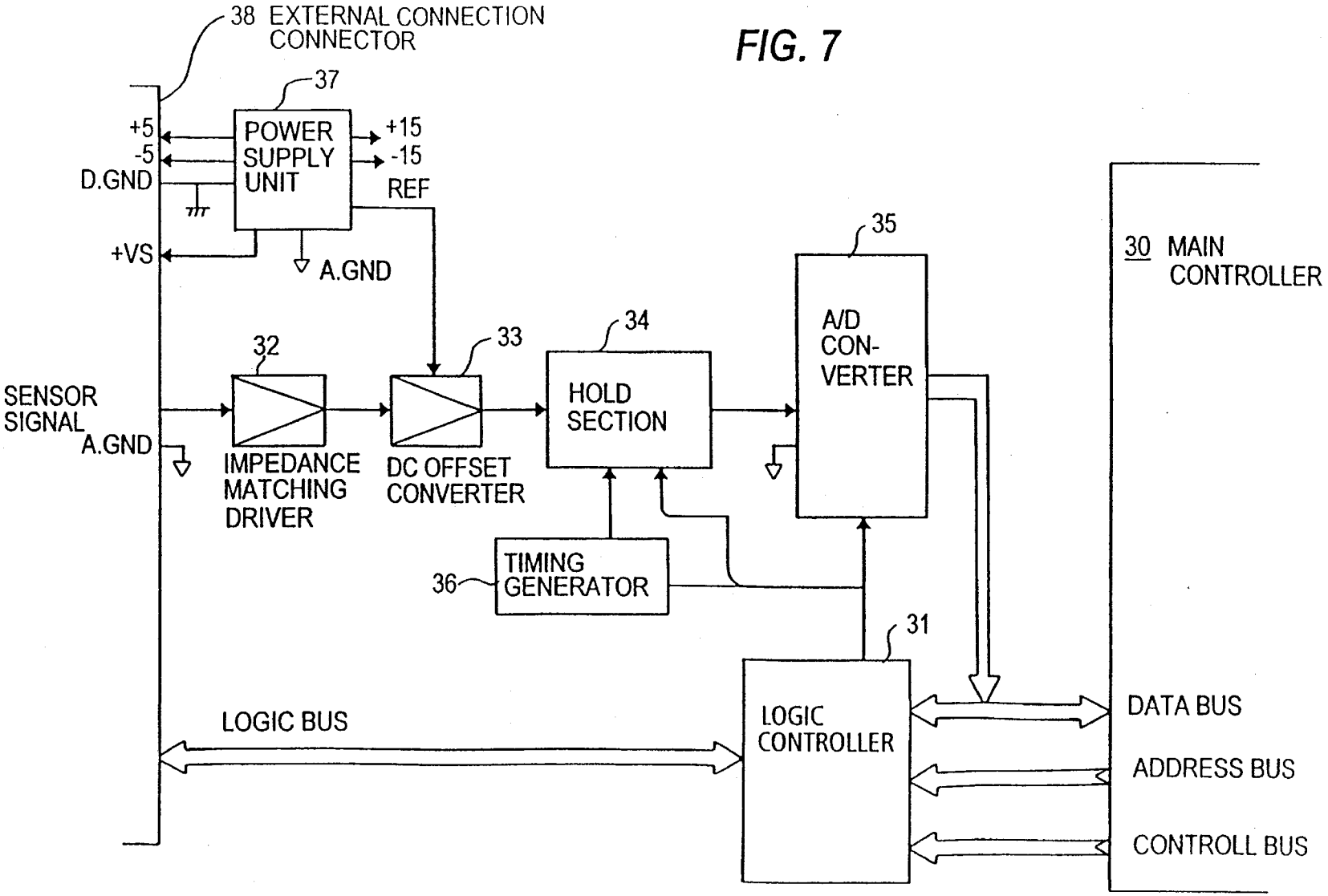
FIG. 7 is a block diagram showing the main controller side in the example signal processing system used in the invention.

A signal processing system providing the metal detector for detecting metal objects is as shown in FIGS. 6 and 7.

The signal processing system, which is under the control of a main controller 30, comprises the main controller 30, a logic controller 31 for repeating control signals, etc. from the main controller 30, an impedance matching driver 32, a DC offset converter 33, a hold section 34, and an A/D converter 35 making up a circuit system for inputting data from the detection matrix 20 to the main controller 30, a timing generator 36, a power supply unit 37, and an external connection connector 38. The logic controller 31 and the circuit system are connected to the external connection connector 38. The main controller consists of a computer containing a central processing unit and a main memory (not shown).

Figure 8:
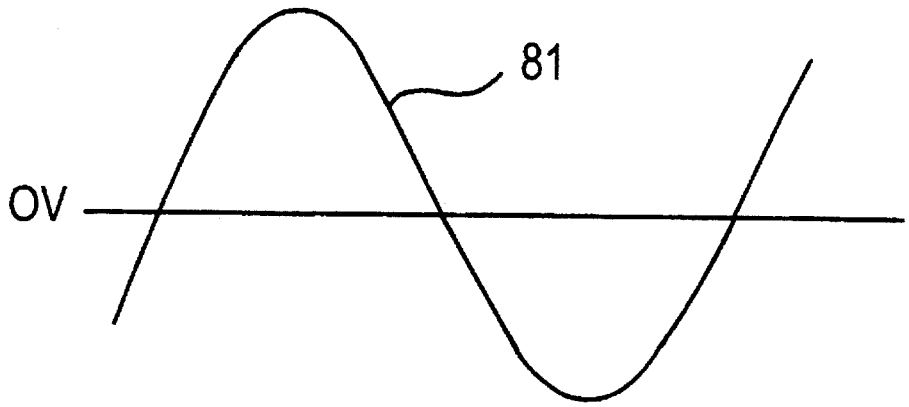
FIG. 8 is a schematic waveform chart showing a voltage waveform fed to transmission lines.

Installed on the side of the game machine 10 in the signal processing system are an output system 40 for feeding power into a plurality of the transmission lines 22 of the detection matrix 20 and an input system 50 from a plurality of the reception lines 26. The output system 40, which is installed on the side of the transmission lines 22, is provided with a transmission driver 41 for inputting signals to the transmission lines 22 in sequence at a predetermined period and a decoder 42 connected to the transmission driver 41 for controlling the transmission driver 41 so that it operates in sequence in response to control signals from the main controller 30, as shown in FIG. 6. A continuous sine wave with 0 V as the center having frequency 1 MHz is preferred, for example, as shown in FIG. 8, as a voltage waveform 81 fed to the transmission line 22.

Further, the output system 40 comprises a logic sequencer 43, a timing generator 44, and a transmission line row counter 45.

The logic sequencer 43 operates in response to control signals from the main controller 30; it synchronizes the decoder 42 in the transmitting system with a multiplexer 52 (described below) in the receiving system and also controls the beginning and end timings of a scanning period of signals output in sequence by the decoder 42.

The timing generator 44 determines the scanning period, which requires a minimum of 10 KHz to cover a movement of a metal object on the board face 11 of the game machine 10, and is set to 100 KHz in the embodiment. The transmission line row counter 45 counts the scanning period for determining the transmission line 22 to be scanned.

The input system 50, which is installed on the side of the reception lines 26, is provided with a converter 51 connected to the reception lines 26 for converting a current representing an electro-magnetic characteristic value of each of the reception lines 26 into a voltage signal that can be handled by digital devices at the following stages and a multiplexer 52 connected to the converter 51 for receiving signals in sequence from the reception lines 26 and outputting them.

A reception line column counter 53 located following the logic sequencer 43 of the output system 40 is connected to the multiplexer 52. The output system 40 and the input system 50 are synchronized with each other by the transmission line row counter 45 and the reception line column counter 53 connected to the logic sequencer 43. In one synchronization mode, for example, one of the reception lines 26 is detected per scan of the transmission lines 22.

In contrast to the synchronization mode, for example, the reception lines 26 scan once per transmission of one of the transmission lines 22 for detection.

An output of the multiplexer 52 of the input system 50 is connected via an impedance converter 54 to the external connection connector 38 to the main controller 30.

Next, the operation of the embodiment is described.

In FIG. 7, when an address signal and a control signal are output from the main controller 30 via an address bus and control bus to the logic controller 31, the logic controller 31 transfers the signals to the game machine 10 through the external connection connector 38.

In FIG. 6, in the game machine 10, the logic sequencer 43 of the output system 40 issues a sequence signal based on the input signals to the decoder 42, the timing generator 44, the transmission line row counter 45, and the reception line column counter 53.

The timing generator 44 determines a scanning period of each transmission line 22 of the detection matrix 20. The transmission line row counter 45 counts scanning period signals for determining the transmission line 22 to be driven. The counter 45 operates in synchronization with the sequence signal from the logic sequencer 43.

The decoder 42 controls the transmission driver 41 so that the transmission driver 41 outputs a signal in sequence to the transmission lines 22 at a predetermined period.

When receiving current signals representing electro-magnetic characteristic values appearing on the reception lines 26, the converter 51 converts the current signals into voltage signals that can be handled by digital circuitry at the following stages.

When receiving the signals into which the signals from the reception lines 26 are converted, the multiplexer 52 outputs the signals in sequence on a predetermined period. The decoder 42 in the transmitting system and the multiplexer 52 in the receiving system operate in synchronization with each other in response to the count of the transmission line row counter 45 and the count of the reception line column counter 53 operating according to control signals of the logic sequencer 43 operating according to control signals.

The logic sequencer 43 causes the converter 51 and the multiplexer 52 in the receiving system to detect information on one of the reception lines 26 per scan of the transmission lines 22 or in contrast causes the reception lines 26 to scan once per transmission of one of the transmission lines 22 for detection.

If a voltage signal having a waveform as shown in FIG. 8 is applied to one transmission line 22, an alternating field occurs in the parallel section 22P of the transmission line 22, whereby an alternating voltage is induced in each reception line 26 crossing the transmission line 22 by electro-magnetic induction.

At this time, if a metal object enters a space assumed by any detection unit **20*a* belonging to the transmission line 22, an eddy current is induced in the metal object. The eddy current generates a magnetic field in a direction to negate a magnetic flux occurring from the parallel section 22P. Thus, the scale of the electro-magnetic induction with respect to the reception line 26 crossing the transmission line 22 at the detection unit 20*a* changes and induced current on the reception line 26 becomes small. On the other hand, such a change does not occur on other reception lines 26 crossing the same transmission line 22 and the scale of induced current does not change. The reception line 26 having its parallel section 26P at the position of the metal object is scanned by the analog multiplexer 52 and the signal is finally sent to the main controller 30 for comparison. As described below, the main controller 30 can check the reception line columns for detecting a specific reception line 26 different from others in output. It can also check the transmission line rows, for example, for detecting the current transmission line 22 being driven. Therefore, the detection unit 20*a*** in which the metal object exists can be known from information on both the reception and transmission lines.

The transmission line 22 being driven can be known, for example, by obtaining the count of the transmission line row counter 45; the reception line 26 selected by the analog multiplexer 52 can be known, for example, by obtaining the count of the reception line column counter 53. Track of the position of the metal object can be kept as coordinates of the position at which the transmission line rows and the reception line columns cross each other.

Since the number of the detection units **20*a* is 1024 in total, from 32 rows of the transmission lines 22 and 32 columns of the reception lines 26, the metal object can be detected even if it passes through any of the safe holes 14 and the out hole 15**.

Since the voltage waveform 81 to the transmission line 22 is a continuous sine wave with 0 V as the center, noise, as with a square wave, does not occur and the effect on other devices such as the main controller 30 can be prevented.

A sensor signal output from the multiplexer 52 is impedance-converted by the impedance converter 54. The resultant sensor signal output from the impedance converter 54 is input through the external connection connector 38 to the impedance matching driver 32 on the side of the main controller 30 for impedance matching. The DC offset converter 33 following the impedance matching driver 32 receives only a reaction wave of output from the detection matrix 20 and outputs it to the hold section 34.

The hold section 34 temporarily stores data transferred at high speed until the A/D converter 35 at the following stage completes A/D conversion. The A/D converter 35 converts analog signals from the detection matrix 20 into digital signals in predetermined bit units, such as 12 bits, and sends the resultant digital data via a data bus to the main controller 30. The operation of the hold section 34 is synchronized with that of the A/D converter 35 in response to a signal of the logic controller 31 or the timing generator 36.

The A/D converter 35 may be provided with another output terminal connected to the memory (not shown) for storing motion of all metal objects on the detection matrix 20 for a long time.

Since the detection matrix 20 consists of the transmission lines 22 and the reception lines 26 which make U turns in parallel and are at right angles to each other, its pattern is simple and unobtrusive and can be easily manufactured with wire such as copper wire. If the line diameter of each of the transmission lines 22 and the reception lines 26 of the detection matrix 20 is made 20 μm or more, DC resistance lowers for providing good reactivity.

The transparent conductive film 28 on the surface of the outer glass unit 17*c* has functions of shielding electric effects of metal and inductors from the outside and of raising reactivity to metal objects.

The positions of the detection units 20*a* corresponding to the safe holes 14*a* are stored and further the position of the out hole 15 is also stored (without detecting metal objects at the out hole 15, the number of metal objects propelled to the board face 11 can be counted as the number of incoming balls) for watching how metal objects enter the holes during the progress of games. Locking up the game machine on a win is possible and a check is made for an error caused by illegal operation according to the situation. Machines where metal objects very easily enter only specific safe holes, machines where metal objects hardly enter safe holes, etc., are detected for use as data to adjust a fluctuation amount imparted to metal objects by pins, etc.

Next, a second embodiment of the invention will be discussed.

Figure 9:
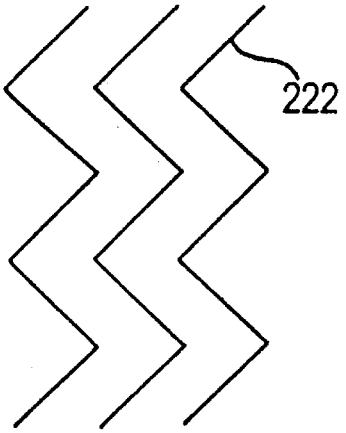
FIG. 9 is a schematic front view showing the form of transmission or reception lines according to a second embodiment of the invention.

FIG. 9 shows the form of transmission or reception lines according to the second embodiment of the invention. That is, the transmission lines (or reception lines) 222 are bent like a zigzag. The second embodiment is the same as the first embodiment except for the form of the transmission or reception lines.

Next, a third embodiment of the invention will be discussed.

Figure 10:
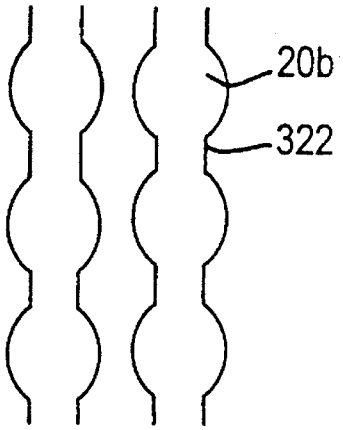
FIG. 10 is a schematic front view showing the form of transmission or reception lines according to a third embodiment of the invention.

FIG. 10 shows the form of transmission or reception lines according to the third embodiment of the invention. That is, the transmission line (or reception line) 322 has the form swollen like a circle in the portion of a detection unit 20*b*. The third embodiment is also the same as the first embodiment except for the form of the transmission or reception lines.

Next, a fourth embodiment of the invention will be discussed.

Figure 11:
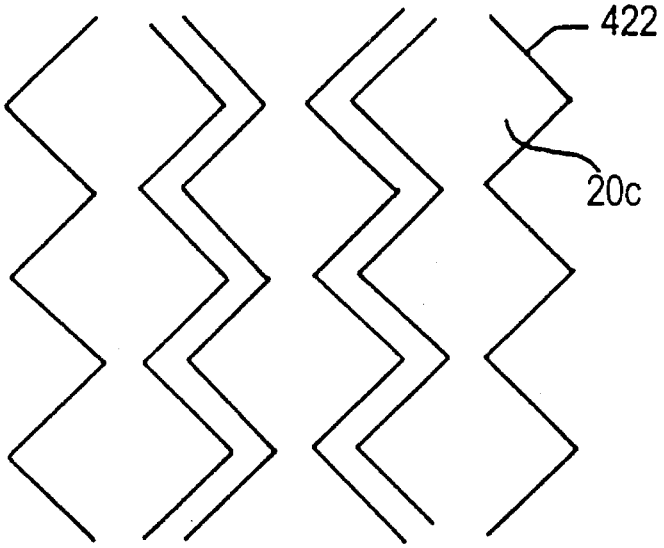
FIG. 11 is a schematic front view showing the form of transmission or reception lines according to a fourth embodiment of the invention.

FIG. 11 shows the form of transmission or reception lines according to the fourth embodiment of the invention. That is, the transmission line (or reception line) 422 is bent like a zigzag and has the form swollen like a square in the portion of a detection unit 20*c* and the zigzag form is engaged with that of its adjacent transmission or reception line. The fourth embodiment is also the same as the first embodiment except for the form of the transmission or reception lines.

As shown in the second to fourth embodiments, the transmission or reception lines can have various forms according to applications, purposes, etc. The transmission and reception lines may be of different line forms in combination.

Next, a fifth embodiment of the invention will be discussed.

Figure 12:
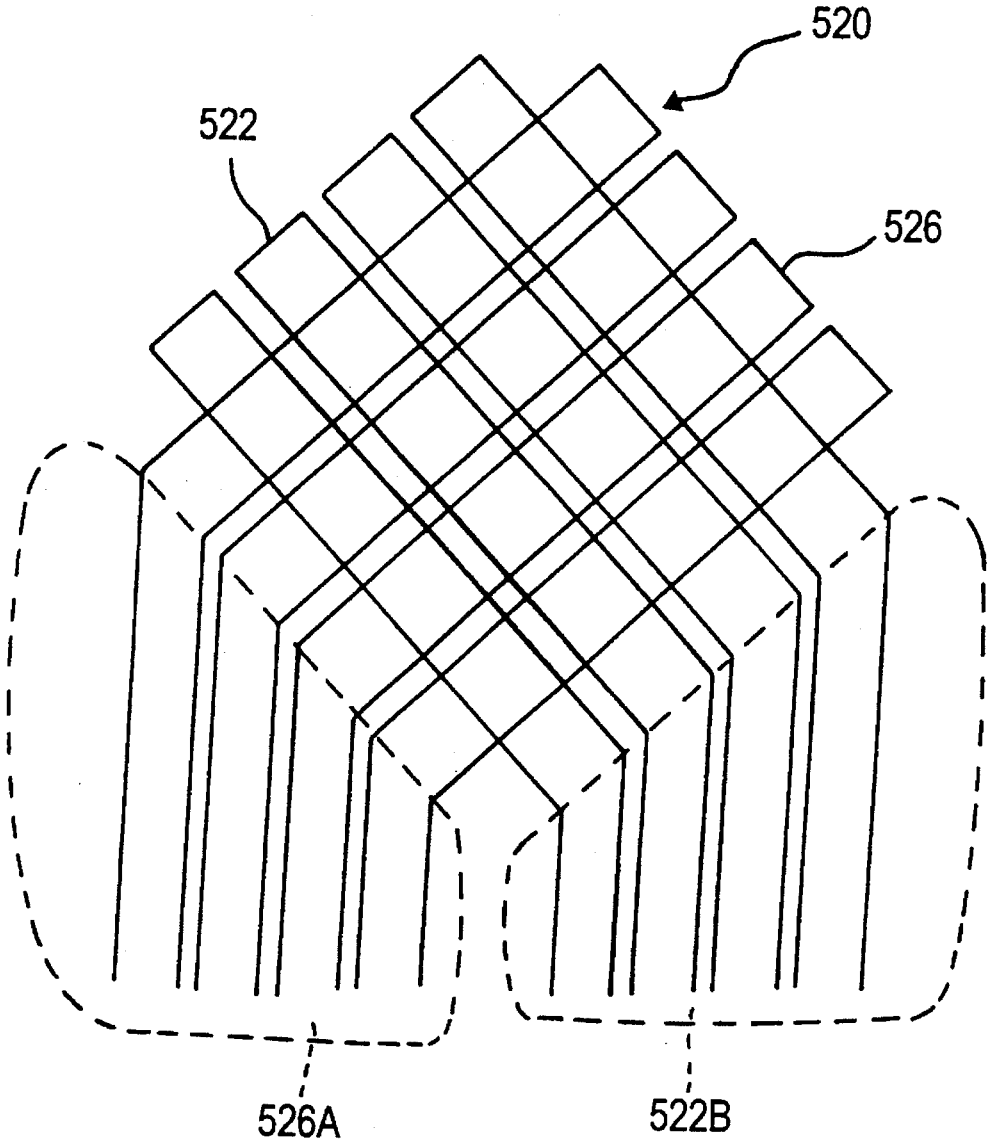
FIG. 12 is a schematic front view showing the form of a detection matrix according to a fifth embodiment of the invention.

FIG. 12 shows the form of a detection matrix according to the fifth embodiment of the invention. That is, a plurality of transmission lines 522 and a plurality of reception lines 526 are introduced from the same direction (in the FIG. 12, from bottom to top) and bent and extended at an angle of 45 degrees in directions to cross each other for forming a layout of a detection matrix 520. The fifth embodiment is the same as the first embodiment except for the form of the detection matrix.

Next, the operation will be described.

The fifth embodiment is designed so that an area 526A and an area 522B become substantially the same in pattern length, as shown in FIG. 12. Thus, the transmission lines 522 and the reception lines 526 differ less in total length. Therefore, as compared with the first embodiment, the transmission lines 522 and the reception lines 526 are substantially the same in DC resistance value and DC resistance can be easily averaged on the transmission lines 522 and the reception lines 526; as a result, reactivity can be averaged.

In the examples given above, the transmission lines 522 and the reception lines 526 are substantially the same in DC resistance value. However, they may differ in DC resistance value depending on applications, purposes, etc., as is the case with the sixth and seventh embodiments of the invention.

Figure 13:
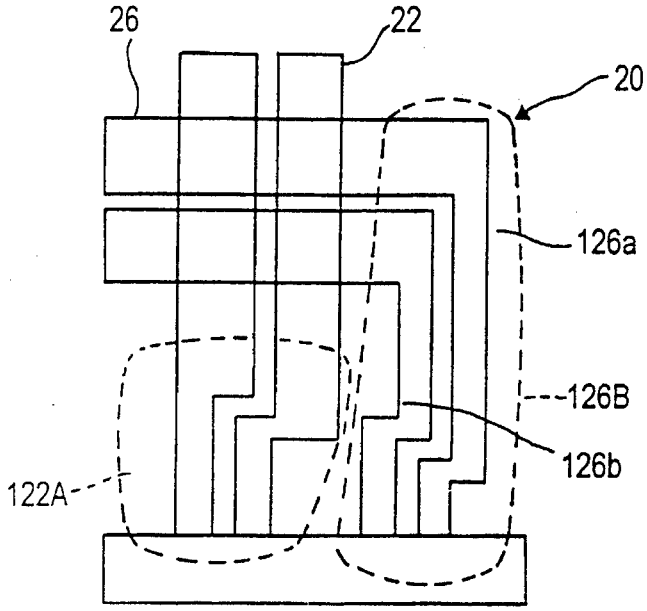
FIG. 13 is a schematic front view showing the form of a detection matrix according to a sixth embodiment of the invention.

FIG. 13 shows the form of a detection matrix according to a sixth embodiment of the invention. The sixth embodiment is the same as the first embodiment except for the form of the detection matrix.

In the sixth embodiment, an area 122A and an area 126B differ extremely in pattern length. Further, in the area 126B, a line portion 126*a* and a line portion 126*b* differ in pattern length. Thus, the transmission lines 22 and reception lines 26 have different DC resistance values.

Figure 14:
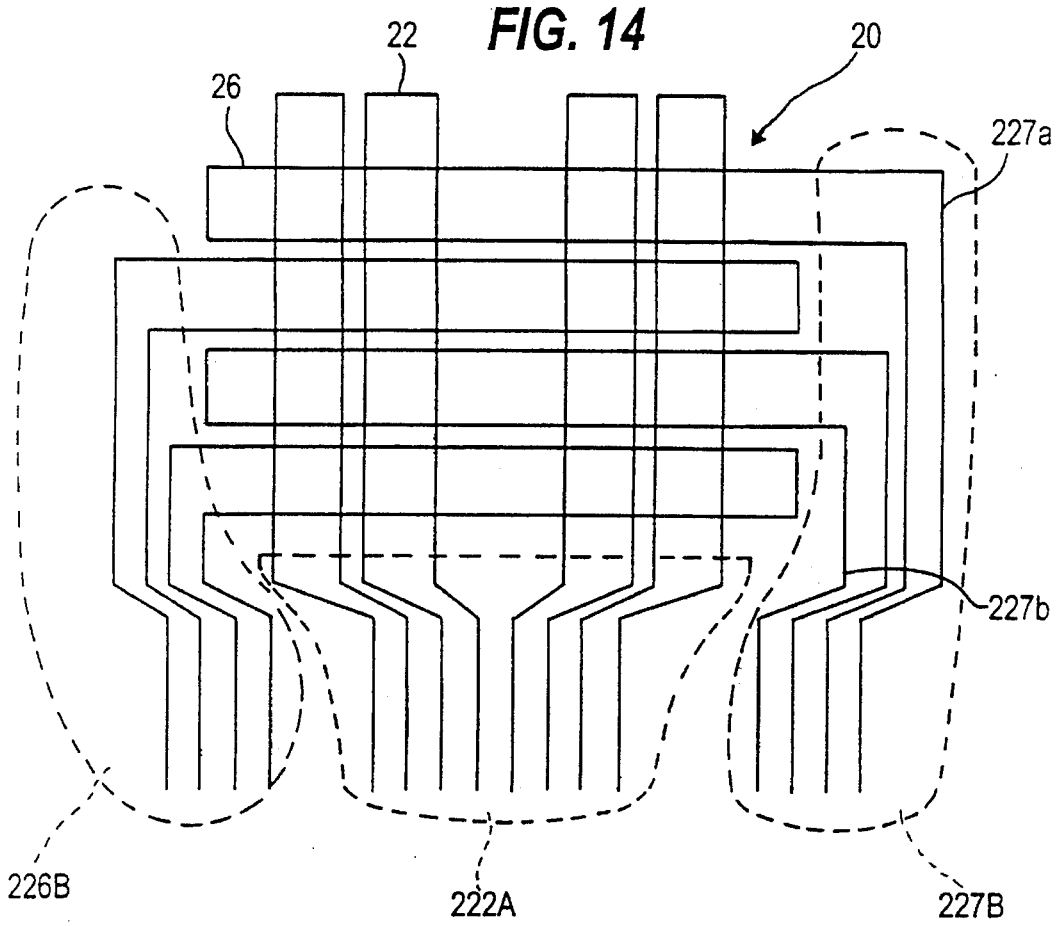
FIG. 14 is a schematic front view showing the form of a detection matrix according to a seventh embodiment of the invention.

FIG. 14 shows the form of a detection matrix according to a seventh embodiment of the invention. The seventh embodiment is the same as the first embodiment except for the form of the detection matrix.

In the seventh embodiment, an area 222A, an area 226B, and an area 227B also differ in pattern length. In the area 227B, a line portion 227*a* and a line portion 227*b* differ in pattern length. Thus, the transmission lines 22 and reception lines 26 differ in DC resistance value.

Thus, the detection matrix can have various forms according to applications, purposes, etc.

Next, an eighth embodiment of the invention will be discussed.

Figure 15:
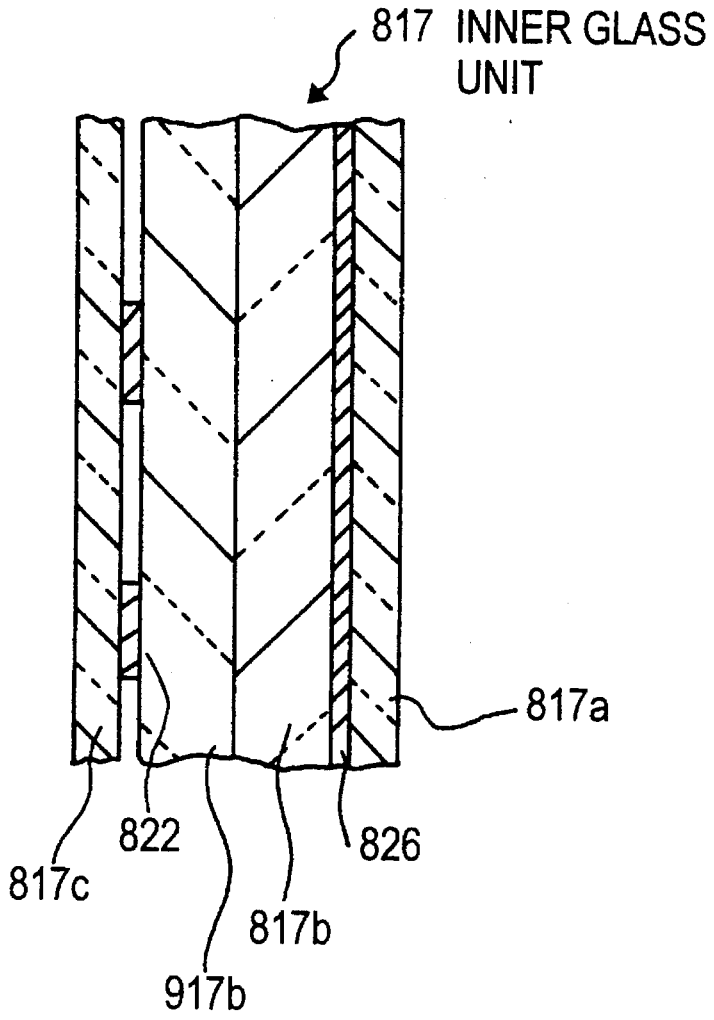
FIG. 15 is an enlarged sectional view of an inner glass unit having a detection matrix according to an eighth embodiment of the invention.

FIG. 15 shows the structure of an inner glass unit having a detection matrix according to the eighth embodiment. That is, the inner glass unit 817 comprises four layers of an internal protection glass plate 817*a*, a reception glass base board 817*b*, a transmission glass base board 917*b*, and an outer glass plate 817*c*, which are laminated on each other. A plurality of reception lines 826 turned in parallel are formed on one side of the reception glass base board 817*b*, on which the internal protection glass plate 817*a* is put.

A plurality of transmission lines 822 turned in parallel are formed on one side of the transmission glass base board

917*b*, on which the outer glass plate 817*c* is put. Then, the inner glass unit 817 is manufactured by putting the board face of the reception glass base board 817*b* and the board face of the transmission glass base board 917*b* together using a transparent adhesive. Others are the same as the first embodiment.

The inner glass unit 817 is thus manufactured by putting the two glass base boards 817*b* and 917*b* together to make it easy to manufacture the inner glass unit 817.

In the embodiment, two glass base boards 817*b* and 917*b* may be made one glass base board having both sides undergoing pattern treatment for forming the turned transmission lines 822 and the turned reception lines 826.

Pattern treatment may also be applied to the internal protection glass plate 817*a* and the outer glass plate 817*c*.

The glass base boards 817*b* and 917*b* may be made of plastic films as well as glass.

Next, a ninth embodiment of the invention will be described.

Figure 16:
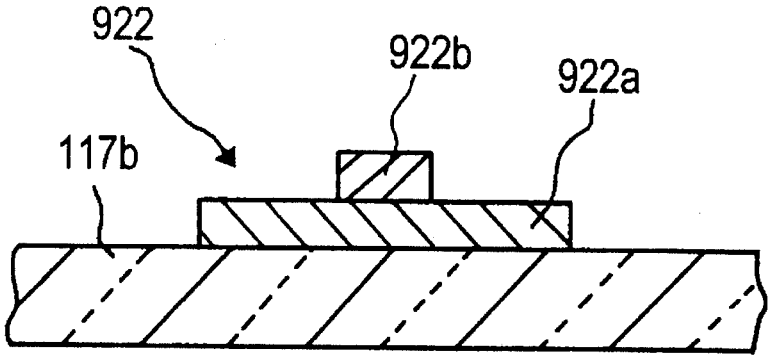
FIG. 16 is an enlarged sectional view of a transmission or reception line according to a ninth embodiment of the invention.

FIG. 16 shows a transmission or reception line according to the ninth embodiment. That is, to form the transmission line 922, a transparent conductive pattern 922*a* of an I.T.O film is formed on one surface of a glass base board 117*b*, on which a film of a metal pattern 922*b* is formed by depositing, plating, or the like of metal such as copper along the transparent conductive pattern.

The I.T.O. film can be formed by thin film techniques such as sputtering, for example. Likewise, to form the reception line, a transparent conductive pattern of an I.T.O film is formed on the other surface of the glass base board 117*b*, on which a film of copper is formed.

According to such a structure, if the copper pattern of the transmission line 922 or reception line is broken, the transparent conductive pattern under the copper pattern is still connected, thereby preventing the transmission or reception line pattern from being broken.

Copper foil may be applied by a conductive adhesive rather than forming a copper film on the I.T.O. film.

In the embodiments, the game machine has been discussed, but use of the detection matrix is not limited to the game machine. For example, the detection matrix can be used to detect a distribution, movement, etc., of metal objects. To use the detection matrix for detecting a distribution of metal objects, for example, if a metal piece of a specific pattern is attached to each commodity and the commodities are placed on the detection matrix, the presence or absence of the commodities can be detected. Therefore, it can be used for inventory management of the commodities. By attaching similar metal pieces to articles, the detection matrix can also be used for quantity control. In addition, it can be applied to a detector for counting and examining metal objects at prize exchange places, etc.

Next, a tenth embodiment of the invention will be described.

Figure 17:
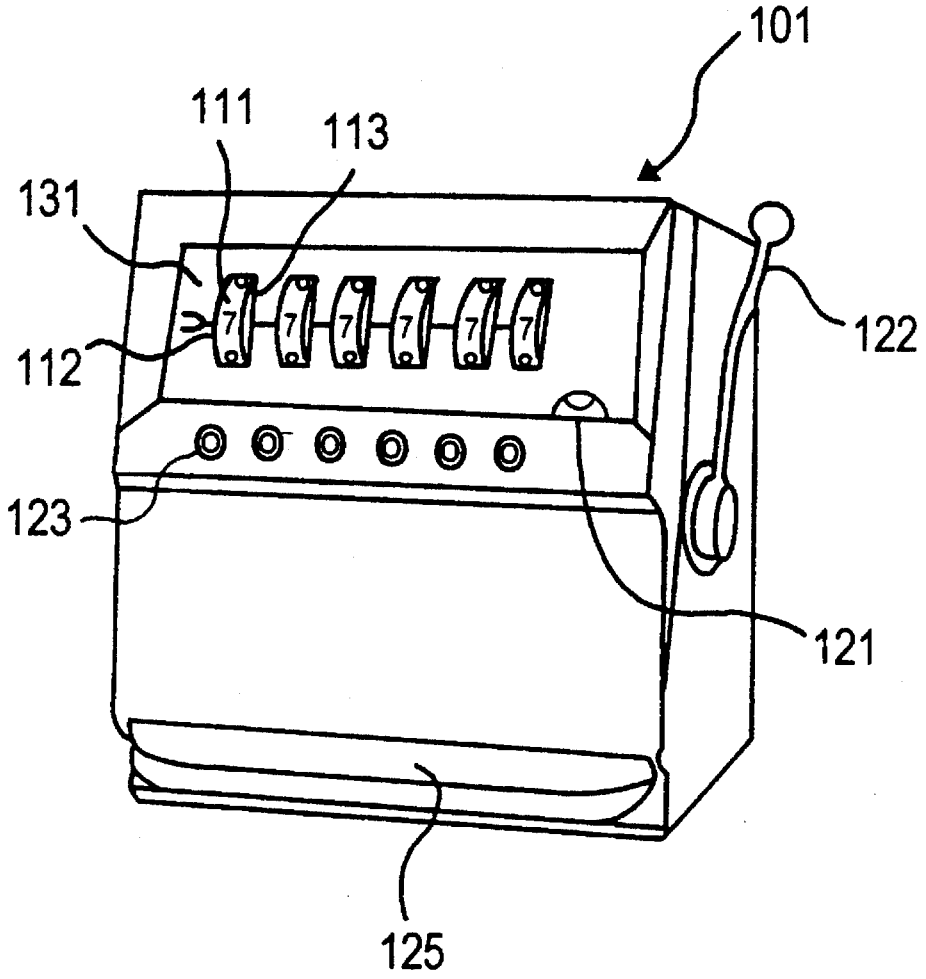
FIG. 17 is a perspective view of a slot machine according to a tenth embodiment of the invention.

FIG. 17 shows a slot machine according to the tenth embodiment of the invention. That is, at the slot machine 101, a plurality of common displays 112 are provided on the outer peripheral surfaces of six rotators 111. A player starts playing a game by inserting a medal into a medal slot 121 and pulling a handle 122 toward them. Then, the rotators 111 rotate at high speed and the player stops the rotators 111 in sequence by pressing stop buttons 123 corresponding thereto in sequence.

Any one of the displays on each rotator 111 is positioned on a display window 113 for each game. When all displays 112 positioned on the display windows 113 provide a predetermined win display, such as "7," a predetermined number of medals, for example, are paid out to the player through a win slot 125 for the winning play.

Each rotator 111 is made of a belt or sheet of a nonconductor such as plastic or rubber and is rotated by two belt pulleys (not shown). Each rotator 111 is positioned with metal such as iron (not shown) attached to the position of a predetermined win display, such as "7." The display windows 113 are covered with a front glass cover 131 which has a similar structure to that of the inner glass unit 17 in the first embodiment (see FIG. 3). The front glass cover 131 is formed with a detection matrix 20 providing a metal sensor. The detection matrix 20 serves as a metal detector for detecting metal as in the first embodiment and will not be discussed again.

Next, the operation will be described.

When the rotators 111 stop, if all of the displays positioned on the display windows 113 provide a predetermined win display, such as "7," the condition is detected by the detection matrix 20. An internal CPU, such as the main controller 30 as shown in FIG. 7, is informed of the positions of metal sensed by the detection matrix 20. When the CPU acknowledges that the displays provide a predetermined win display, a predetermined number of medals, for example, are paid out to the player through the win slot 125 for the winning play accordingly.

The detection matrix 20 may be installed in the slot machine 101 as well as formed on the display windows 113 on the front of the slot machine 101. To detect the metal positions, the start positions of the rotators 111 are checked by the detection matrix 20 and then the metal positions may be detected by the internal CPU.

As in the first embodiment, the front glass cover 131 in the tenth embodiment may consist of a surface glass unit 16 and an inner glass unit 17.

In the embodiments, for example, the detection matrix can provide a metal form determination device for determining the metal form like a printed wiring board or an indication position detection sensor such as a touch sensor. For example, when the metal wiring portion of a printed wiring board is placed on the detection matrix, the metal form determination device can detect the position of metal. When an indication member having at least a metal object on the tip is used and the tip is made to approach any position on the detection matrix, the indication position detection sensor detects the indication position by the detection matrix.

If the density of the detection matrix is made appropriate, metal objects can be traced and games can also be monitored in detail. The detection matrix may be disposed on the rear of the board face of the game machine.

The conductors forming the transmission lines 22 and the reception lines 26 may be metal such as aluminum or gold as well as copper or transparent conductive films such as indium oxide films or tin oxide films.

In the embodiments described above, each sensor comprises a detection matrix, which has a plurality of transmission lines and reception lines, but may have a simple structure of one transmission line and one reception line.

As described above, according to the embodiments of the invention, any desired position of a metal object existing in a specific space can be detected in a noncontact condition without involving physical contacts. Therefore, according to the invention, problems involved in presence of contacts, etc., are solved and durability and reliability can be improved in detection of metal objects.

Particularly, the invention is appropriate for detection of the position of a metal object moving or being still within a parallel plane space. For example, with a game machine, data such as trace of metal objects on the board face, the number of metal objects propelled by a player, and percentage of metal objects entering safe holes can be obtained easily and quickly and games can be known in detail at a distant location, thus the level of count control of game machines can be raised and nails of game machines can be easily adjusted by anybody.

A distribution of metal objects on a plane can also be easily detected.

The invention can be applied to various devices if they are devices for detecting the position of a metal object existing in a specific space. For example, it can be applied to detection of the path of a metal object at a game machine where a player moves metal objects along the board face. When metal objects are placed on the detection matrix according to the invention, a position distribution of the metal objects can be detected. A device for recognizing the metal object form by using the presence distribution of the metal objects can be constructed. A system for managing articles by using information on the presence distribution of the metal objects can be built. Further, a sensor for entering indication, etc., by making a metal object approach a desired position on the detection matrix according to the invention can be constructed.

We claim:

1. A sensor for detecting a position of a metal object comprising a plurality of transmission lines being energized for generating a magnetic field, a board for supporting said transmission lines, a plurality of reception lines being electro-magnetically coupled with said transmission lines for detecting a magnetic flux change made by an approach of the metal object, and a board for supporting said reception lines, wherein said transmission lines and said reception lines are made of conductive thin films formed on their respective boards, each transmission and reception line having sending and returning paths, the sending path being coupled to and substantially in parallel with the returning path, said transmission lines and said reception lines being spaced apart by said boards and being laid out in a direction to cross each other.

2. A sensor as claimed in claim 1 wherein said transmission lines and said reception lines cross each other so that their cross portions are laid out like a matrix.

3. A sensor as claimed in claim 2 wherein areas surrounded by the sending and returning paths of said transmission lines and said reception lines in the cross portions are substantially quadrilaterals.

4. A sensor as claimed in claim 2 wherein said transmission lines and said reception lines each comprise a layer of a metal pattern formed on each of the boards, and a metal film formed on said metal pattern, said metal pattern and said metal film constituting said conductive thin film.

5. A sensor as claimed in claim 4 wherein said boards are glass boards.

6. A sensor as claimed in claim 4 wherein a direct current resistance value of each of said transmission lines and said reception lines is set in the range of 20Ω to 200Ω.

7. A sensor as claimed in claim 2 wherein said board on which said transmission lines are formed and said board on which said reception lines are formed have their sides on which a conductive thin film is not formed put together.

8. A sensor as claimed in claim 2 wherein said board on which said transmission lines are formed and said board on which said reception lines are formed are the same, said board having one side formed with the transmission lines and the other side formed with the reception lines.

9. A sensor as claimed in claim 2 wherein said transmission and reception lines each comprises a transparent conductive film formed on said board and a metal film formed on the transparent conductive film as the conductive thin film.

10. A sensor as claimed in claim 9 wherein said boards are glass boards.

* * * * *